United States Patent [19]

Kato

[11] Patent Number: 4,888,482

[45] Date of Patent: Dec. 19, 1989

[54] ATMOSPHERIC PRESSURE IONIZATION MASS SPECTROMETER

[75] Inventor: Yoshiaki Kato, Mito, Japan

[73] Assignee: Hitachi, Ltd., Tokyo, Japan

[21] Appl. No.: 175,264

[22] Filed: Mar. 30, 1988

[30] Foreign Application Priority Data

Mar. 30, 1987 [JP] Japan ..... 62-76569

[51] Int. Cl.[4] ..... H01J 49/26

[52] U.S. Cl. ..... 250/281; 250/423 F; 250/288

[58] Field of Search ..... 250/281, 282, 288, 288 A, 250/423 R, 423 F

[56] References Cited

U.S. PATENT DOCUMENTS

| | | | |
|---|---|---|---|
| 3,852,595 | 12/1974 | Aberth | 250/423 F |
| 4,110,612 | 8/1978 | Ligon | 250/281 |
| 4,144,451 | 3/1979 | Kambara | 250/281 |

FOREIGN PATENT DOCUMENTS

| | | | |
|---|---|---|---|
| 1171641 | 8/1961 | Fed. Rep. of Germany | 250/423 F |
| 57-25944 | 6/1982 | Japan . | |
| 1442998 | 7/1976 | United Kingdom | 250/423 F |

OTHER PUBLICATIONS

"High-Rate Growth of Dendrites on Thin Wire Anodes for Field Desorption Mass Spectrometry", Linden et al., *J. Phys. E. Sci. Inst.*, vol. 11, 1978, pp. 1033–1036.

Thomas R. Covey et al, "Liquid Chromatography/-Mass Spectrometry", Analytical Chemistry, vol. 58, No. 14, Dec. 1986, pp. 1451–1461.

E. C. Horning et al, "Liquid Chromatograph-Mass Spectrometer-Computer Analytical Systems, A Continuous-Flow System Based on Atmospheric Pressure Ionization Mass Spectrometry", Journal of Chromatography 99, 1974, pp. 13–21, p. 15.

*Primary Examiner*—Bruce C. Anderson

*Attorney, Agent, or Firm*—Antonelli, Terry & Wands

[57] ABSTRACT

An atmospheric pressure ionization mass spectrometer includes an ionization unit having corona discharge mechanism for introducing thereto gaseous mobile phase molecules and gaseous solute molecules and ionizing the mobile phase molecules through corona discharge under an atmosphere of the mobile phase molecules and the solute molecules; an ion reaction unit for ionizing the solute molecules through molecular ion reaction of the ionized mobile phase molecules with the solute molecules; and an ion analysis unit for mass analyzing the ionized solute molecules; wherein the corona discharge mechanism comprises a discharge electrode for conducting corona discharge at a plurality of points, and a DC power supply for applying a DC voltage to the discharge electrode.

10 Claims, 4 Drawing Sheets

ATMOSPHERIC PRESSURE IONIZATION MASS SPECTROMETER

BACKGROUND OF THE INVENTION

The present invention relates to a mass spectrometer and more particularly, to an atmospheric pressure ionization mass spectrometer capable of correctly analyzing a mass of solutes even under an atmosphere containing a large amount of absorptive substances such as organic compounds.

A liquid chromatograph (hereinafter simply called "LC") is a means for separating mixtures with excellent results, but it has a very poor capability of identifying compounds, i.e., a very poor qualitative performance. On the other hand, a mass spectrometer (hereinafter simply called "MS") has an excellent qualitative performance, but it cannot be used in analyzing mixtures. It becomes possible to analyze mixtures if LC and MS are directly coupled together. However, since MS analyzes samples in vacuum conditions, liquids directly introduced to MS cannot undergo the analysis, thus necessiating an interface between LC and MS. Atmospheric Pressure Ionization (API) has been proposed heretofore as such an interface. Examples of an atmospheric pressure ionization mass spectrometer using API are shown, for example, in No. JP-B-57-25944; Thomas R. Covey et al., "Liquid Chromatography/Mass Spectrometry", ANALYTICAL CHEMISTRY, Vol. 58, No. 14, Dec. 1986, p. 1456; and E. C. Horning et al., "Liquid Chromatograph-Mass Spectrometer-Computer Analytical Systems, A Continuous-Flow System Based on Atmospheric Pressure Ionization Mass Spectrometry", Journal of chromatography, 99, 1974, 13–21, p. 15.

FIG. 1 is a block diagram of a liquid chromatograph-mass spectrometer (LC/MS) analytical system, corresponding to that shown in FIG. 1, p. 15 of "Journal of Chromatography", to which the present invention is applied.

As shown in FIG. 1, an effluent of mobile phase and solutes from LC 1 is introduced to an LC/MS interface 2 wherein the effluent is first vaporized at a spray/vapor chamber 3 and directed to an ion source unit 4. The molecular solutes are ionized at the ion source unit 4, and introduced to an ion analysis unit 5 made of a mass spectrometer (MS) to be mass analyzed. The ion source unit 4 and the ion analysis unit 5 constitute an atmospheric pressure ionization mass spectrometer one example thereof described in No. JP-B-57-25944 being shown in FIG. 2.

Referring to FIG. 2, reference numeral 11 denotes an inlet for sample gas, 12 an ionization section, 13 a molecular ion reaction chamber, 5 an ion analysis unit, 15 a corona discharge needle electrode for ionizing sample gas, 17 a secondary electron multiplier for use in detecting ions, 18 an auxiliary electrode having a first small aperture 20*a* (e.g., 200 μm in diameter), 21 an electron gun, 22 an electron beam control electrode, 23 an ion attraction and acceleration electrode, 24 an ion lens electrode, 14 a variable DC voltage source with an output of 4 to 5 kV, 16 a quadrupole, 26 a DC amplifier, and 28 a data processor.

The molecular ion reaction chamber 13 is connected to a vacuum pump (not shown) and also acts as a room for differential pumping.

The electron gun 21 is used for electron bombardment for the calibration of ion mass.

Using the above atmospheric pressure ionization mass spectrometer will be described, by way of example, how organic compounds contained in nitrogen gas are analyzed at an atmospheric pressure. Corona discharge between the corona discharge needle electrode 15 and the auxiliary electrode 18 within the ionization unit 12 causes nitrogen gas to be ionized into nitrogen ions which are introduced into the molecular ion reaction chamber 13. In the molecular ion reaction chamber 13, nitrogen ions are subjected to molecular ion reaction with a minute amount of water in the order of several ppm contained in nitrogen gas, to thereby produce $H_3O^+$ ions which are subjected to molecular ion reaction with organic compounds likely to be ionized and contained in nitrogen gas to ionize them. A small amount of organic compound ions thus produced are introduced via the small aperture 20*a* into the ion analysis unit 5 to be separated and analyzed.

Conventional atmospheric pressure mass spectrometers of this type have an excellent sensitivity in detecting a minute amount of components contained in a gas, but they cannot be used in analyzing a specimen containing a large amount of absorptive substances such as organic compounds. The reason for this is that a large amount of organic compounds contained in the gas are deposited on the needle electrode generating corona discharge, and are changed in to macromolecule compounds of insulative nature, thereby leading to unstable discharge. Namely, deposition of insulative macromolecule compounds on the needle electrode decreases a corona current and reduces ion current output. In the meantime, the potential of the needle electrode rises to ultimately result in dielectric breakdown and an abrupt rise in ion current output.

Therefore, as corona discharge becomes unstable, ion current output also becomes unstable so that it is difficult to stably conduct chromatography and mass spectrometry, with the essential high sensitivity of API impaired.

Different from the ionization of impurities in pure gas, an LC/MS system transports a liquid in the amount of several ml/minute to several l/minute so that after vaporization it changes to a volume from several l/minute to several ml/minute. Consequently, the needle electrode 15 is likely to be contaminated with organic compounds or the like.

The spectrometer shown in FIG. 3 was used in measuring an output ion current I, i.e., an output current from the DC amplifier 26, using lipids such as monogalactosyl diacyl glycerol as specimen to be analyzed, the measurement result being shown in FIG. 3. As apparent from FIG. 3, the output ion current unstably fluctuated between a range of about ΔI so that, of the main components (1) to (5) of the specimen the components (4) and (5) with a low output ion current, could not be detected.

SUMMARY OF THE INVENTION

It is an object of the present invention to provide an atmospheric pressure ionization mass spectrometer capable of stably generating corona discharge even under an atmosphere containing a large amount of absorptive substances such as organic compounds and thereby analyzing a specimen stably and with high sensitivity.

To achieve the above object, the corona discharge mechanism of an ionization unit uses an electrode which can discharge at a plurality of points, instead of using a single needle electrode.

In particular, a discharge electrode has an increased number of corona discharge points to thereby permit corona discharge to occur at plural positions of the electrode. Therefore, even if organic compounds are deposited on one of the discharge points of the electrode, the remaining discharge points continue the corona discharge so that the electrode as a whole can hold stable corona discharge. In addition, even if one of the discharge points of the electrode stops its discharge due to deposition of organic compounds, the potential of the stopped discharge point of the electrode rises while the remaining discharge points continue the corona discharge, so that the deposited compounds are destroyed and dispersed by discharge breakdown and the stopped discharge point accordingly resumes corona discharge.

DESCRIPTION OF THE PREFERRED EMBODIMENTS

Typical embodiments of an atmospheric pressure ionization mass spectrometer according to the present invention will be described with reference to the accompanying drawings.

Figure 2:
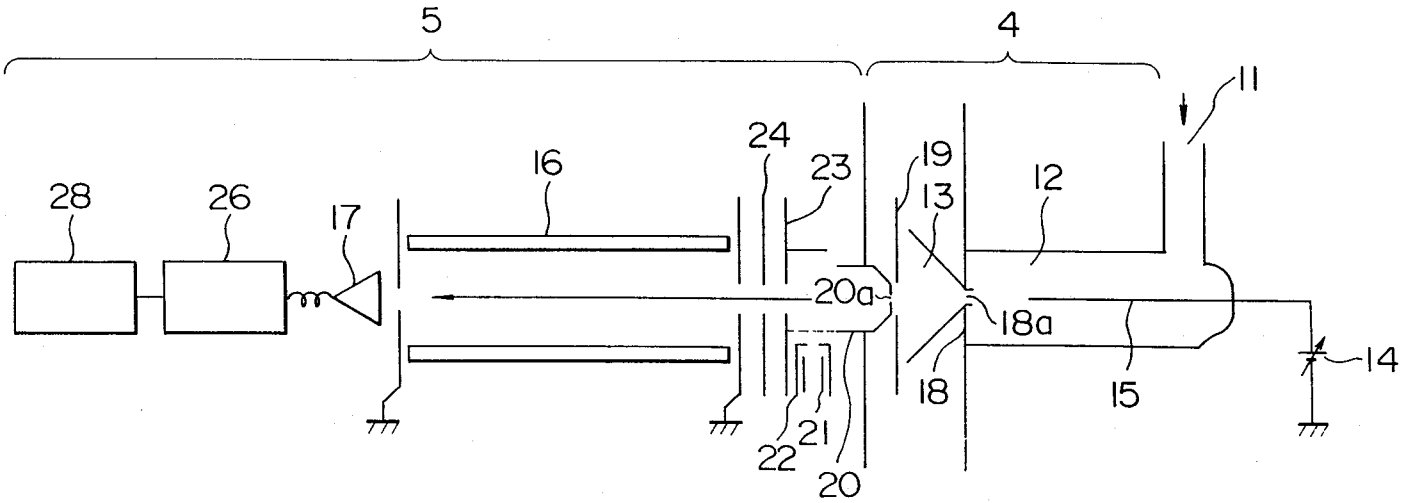
FIG. 2 PRIOR ART
FIG. 2 shows an example of a conventional atmospheric pressure ionization mass spectrometer.
Figure 4:
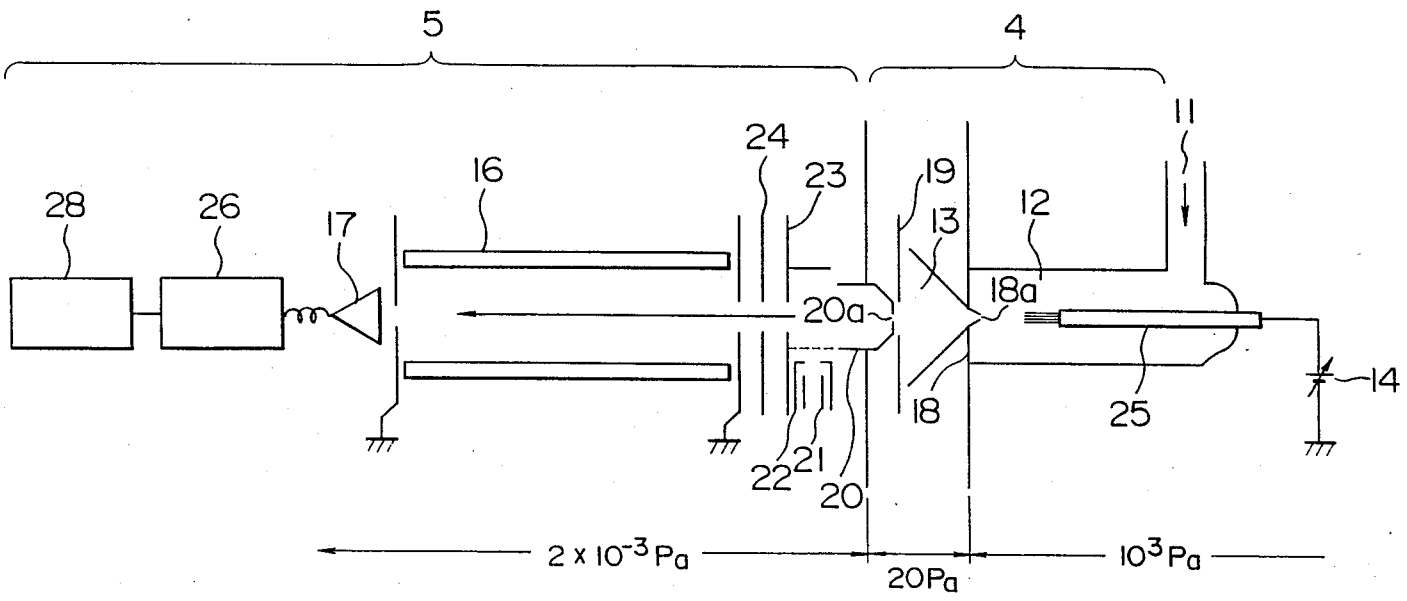
FIG. 4 shows an embodiment of an atmospheric pressure ionization mass spectrometer according to the present invention.

FIG. 4 shows an embodiment of an atmospheric pressure ionization mass spectrometer according to the present invention, wherein elements having similar function to those shown in FIG. 2 are represented by using identical reference numerals, and the description therefor is omitted.

The pressure is preferably $10^3$ pascal in an ionization unit 12, 20 pascal at a molecular ion reaction chamber 13, and $2\times10^{-3}$ pascal at an ion analysis unit 5.

Figure 5A:
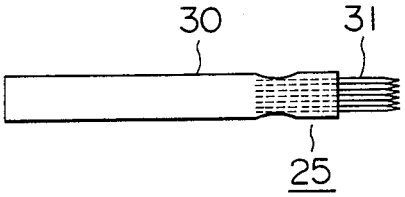
FIGS. 5A and 5B are side and front views showing an embodiment of a discharge electrode according to the present invention.
Figure 5B:
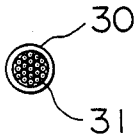

In this embodiment, a discharge electrode 25 or corona discharge mechanism serving as ionization means in the ionization unit 12, is constructed as shown in FIGS. 5A and 5B. Namely, as shown enlarged in FIGS. 5A and 5B, the discharge electrode 25 is constructed of an assembly of a plurality of needle electrodes 31, the tip of each needle electrode serving as a discharge point so that the discharge electrode as a whole discharges at plural points. The number of needle electrodes may be two at a minimum, but it is preferable to have ten or more needle electrodes for the purpose of stable corona discharge. Each needle electrode 31 may preferably be a tungsten wire, a rhenium wire or a stainless wire having a diameter of about 50 μm and a length of about 30 mm, all the needle electrodes being bundled together, inserted into a stainless tube 30 having an inner diameter of about 1.0 mm to 1.5 mm, and fixed in place by squeezing the stainless tube. The finished discharge electrode constitutes a multiple point discharge electrode. Each tip of the needle electrode 31 has a sharp edge, with distance between adjacent tips not needed to be limited specifically.

Organic compounds particularly suitable for a specimen of the present invention include carbo hydrate, peptide, lipid and the like. Mobile phase or solvents include water, methanol, acetonitrile and the like.

The operation of the embodiment spectrometer applied to the LC/MS system shown in FIG. 1 will now be described. A mobile phase (liquid; containing a large amount of organic compound effluent from LC 1 is vaporized at a spray/vapor chamber 3 and introduced via an inlet 11 to an ion source unit 4. A voltage of 3 to 9 kV is applied to the multiple point discharge electrode of the ion source unit 4 so that the mobile phase is ionized in the ionization unit 12 under corona discharge.

The ionized mobile phase is introduced to the molecular ion reaction chamber 13 to be subjected to molecular ion reaction with solutes such as organic compounds. The ionized organic compounds are mass analyzed in the ion analysis unit 5.

Organic compounds present in the ionization unit 12 to a large extent are deposited on the discharge electrode 25. However, the discharge electrode is an assembly of a plurality of needle electrodes 31 so that even if some of the needle electrodes 31 are deposited with organic compounds, the remaining needle electrodes continue corona discharge, thus maintaining the corona discharge of the discharge electrode as a whole. An ion current output also remains stable.

Alternatively, even if some of the needle electrodes 31 deposited with organic compounds stop their corona discharge, the potentials of the stopped discharge needle electrodes rise while the remaining needle electrodes continue the corona discharge, so that the deposited compounds are destroyed and dispersed by discharge breakdown and the stopped discharge needle electrodes thereby resume their corona discharge. Even if deposition and dispersion of organic compounds are repeated at some needle electrodes the discharge electrode 25 as a whole can maintain a stable corona discharge for a long period.

Stopping and resuming of corona discharge by the discharge electrode occurs also in the case of a conventional single needle electrode discharging at a single point. However, in this case, the discharge completely stops during this period. Thus, a stable corona discharge and stable ion current output are not possible.

Figure 6:
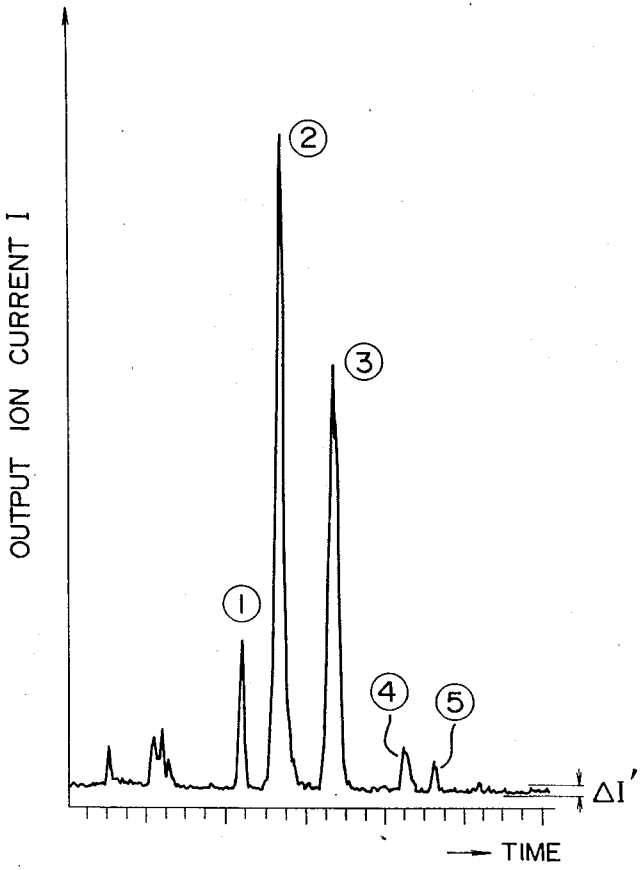
FIG. 6 shows one example of a measurement result with the mass spectrometer according to the present invention.
Figure 3:
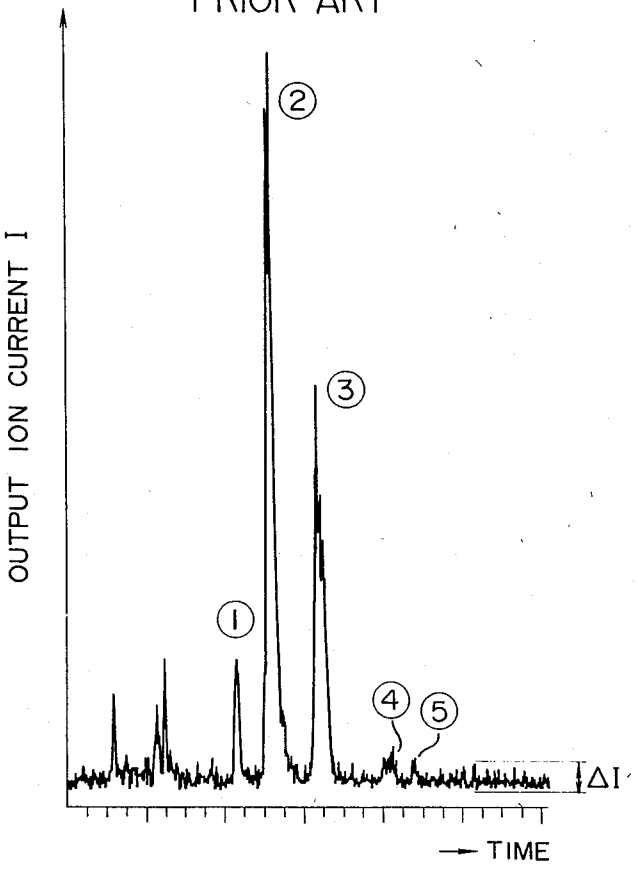
FIG. 3 PRIOR ART
FIG. 3 shows one example of a measurement result of a specimen with the mass spectrometer shown in FIG. 2.

Shown in FIG. 6 is a measurement result of an ion output current I with this embodiment, using lipids such as monogalactosly diachyl glycerol as solutes. As apparent from FIG. 6, the fluctuation range $\Delta I'$ of an ion current output is extremely small as compared with a conventional one shown in FIG. 3, thus enabling the detection of the components (4) and (5) of the specimen. In other words, an S/N (signal to noise) ratio of an ion current output is considerably improved.

Another example of a multiple point discharge electrode used in this invention will be described with reference to FIGS. 7A and 7B.

An elongated wire of tungsten, rhenium or the like is generally formed with micro concavities and convexities on the circumferential surface during manufacturing. By using concavities as the discharge points, this elongated fine wire can be used as a discharge electrode having a plurality of discharge points on the circumferential surface. The fine wire may preferably have a diameter of about 20 to 100 μm.

Figure 7A:
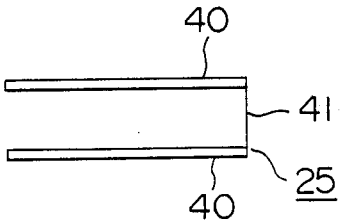
FIGS. 7A and 7B are side and front views showing another example of a discharge electrode used in the present invention.
Figure 7B:
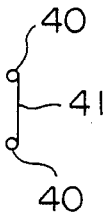

FIGS. 7A and 7B are side and front views of a discharge electrode using such a fine wire. In the figure, reference numeral 40 denotes a conductive support made of, e.g., copper, and reference numeral 41 denotes a fine tungsten or rhenium wire. By applying a DC voltage to the support 40, corona discharge occurs at the fine wire 41. In FIG. 7A, the aperture 18a is assumed as positioned at the right side.

Figure 8A:
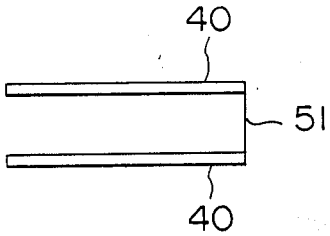
FIGS. 8A, 8B and 8C are side, front and enlarged views showing a further example of a discharge electrode used in the present invention.
Figure 8B:
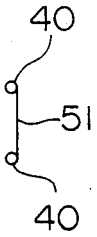
Figure 8C:
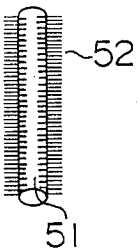

A further example of a multiple point discharge electrode is shown in FIGS. 8A to 8C.

In this example, a plurality of whiskers 52 (see FIG. 8C) made of tungsten, silicon, carbon or the like are grown on the periphery of a fine wire made of tungsten, rhenium or the like having a diameter of about 10 to 20 μm, each whisker being used as a discharge point. Thus, by applying a DC voltage to the support 40, corona discharge occurs at the tips of the whiskers 52 grown on the periphery of the fine wire 51.

These whiskers may be ones used as ionization means for mass analysis in Field Desorption. In FIG. 8A, the aperture **18*a*** is assumed as positioned at the right side.

Figure 9A:
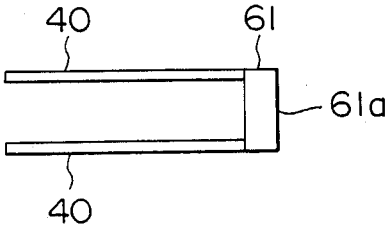
FIGS. 9A and 9B are side and front views showing a still further example of a discharge electrode used in the present invention.
Figure 9B:
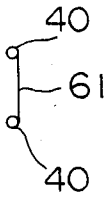

A still further example of a multiple point discharge electrode is shown in FIGS. 9A and 9B.

In this example, a knife edge portion of a safety razor or the like is used as a multiple point discharge electrode. A knife edge has micro concavities and convexities, the latter serving as discharge points. A plurality of discharge points are accordingly disposed laterally of the knife edge. The number of discharge points may be multiplied by using a plurality of knife edges. By applying a DC voltage to the support 40 on which the knife edge 61 is supported, corona discharge occurs at the knife edge 61. In FIG. 9A, the aperture **18*a*** is assumed as positioned at the right side.

The discharge electrodes shown in FIGS. 7A and 7B to FIGS. 9A and 9B have similar operation and effect to those of the discharge electrode shown in FIGS. 5A and 5B.

According to the present invention, a discharge electrode is constructed of a multiple point discharge electrode structure so that even if one discharge point is deposited with organic compounds and its discharge is stopped, the corona discharge of the discharge electrode as a whole does not become unstable. Therefore, even under an atmosphere containing a large number of organic compounds mass analysis can be performed stably and with high sensitivity.

Further, even if one discharge point deposited with organic compounds stop its discharge, the potential of the discharge stopped point rises while the remaining discharge points hold the corona discharge, so that the corona discharge from the once discharge stopped point will resume, to thus improve the overall discharge stability.

Figure 1:
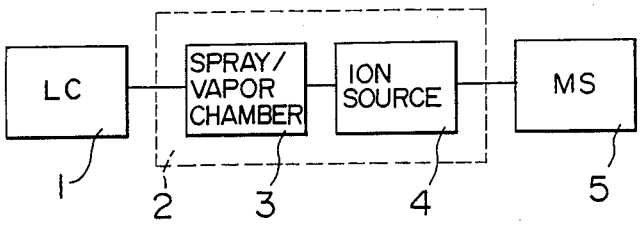
FIG. 1 is a block diagram showing a liquid chromatograph-mass spectrometer (LC/MS) analytical system to which the present invention is applied.

In the above embodiments, the description has been directed to the case where the atmospheric pressure ionization mass spectrometer of this invention is applied to the LC/MS system shown in FIG. 1. However, the invention may be applied to a system with LC 1 and the spray/vapor chamber 3 shown in FIG. 1 removed therefrom. In this case, gas of vaporized organic substances or the like is introduced into the inlet 11 shown in FIG. 4. Further, in the present invention, solutes are not limited to organic compounds but other substances may be used.

I claim:

1. An atmospheric pressure ionization mass spectrometer comprising:

an ionization unit having corona discharge means for introducing thereto gaseous mobile phase molecules and gaseous solute molecules, and ionizing said mobile phase molecules through corona discharge under an atmosphere of said mobile phase molecules and said solute molecules;

an ion reaction unit for ionizing said solute molecules through molecular ion reaction of said ionized mobile phase molecules with said solute molecules; and an ion analysis unit for mass analyzing said ionized solute molecules;

wherein said corona discharge means comprises discharge electrode means for conducting corona discharge at a plurality of points, and a DC power supply for applying a DC voltage to said discharge electrode means.

2. An atmospheric pressure ionization mass spectrometer according to claim 1, wherein said discharge electrode means comprises an assembly of a plurality of needle electrodes.

3. An atmospheric pressure ionization mass spectrometer according to claim 1, wherein said discharge electrode means is a circumferential surface of a fine conductive wire whose diameter is in the range of about 20 to 100 μm.

4. An atmospheric pressure ionization mass spectrometer according to claim 1, wherein said discharge electrode means comprises a plurality of whiskers formed on a periphery of a fine conductive wire.

5. An atmospheric pressure ionization mass spectrometer according to claim 1, wherein said discharge electrode means comprises a knife edge portion.

6. An atmospheric pressure ionization mass spectrometer comprising:

a liquid chromatograph for separating a liquid mixture of a specimen and eluting therefrom liquid mobile phase molecules and liquid solute molecules;

vaporizing means for vaporizing said eluted liquid mobile phase molecules and liquid solute molecules;

an ionization unit having corona discharge means for introducing thereto gaseous mobile phase molecules and gaseous solute molecules and ionizing said mobile phase molecules through corona discharge under an atmosphere of said mobile phase molecules and said solute molecules;

an ion reaction unit for ionizing said solute molecules through molecular ion reaction of said ionized mobile phase molecules with said solute molecules; and an ion analysis unit form ass analyzing said ionized solute molecules;

wherein said corona discharge means comprises discharge electrode means for conducting corona discharge at a plurality of points of said discharge means, and a DC power supply for applying a DC voltage to said discharge electrode means.

7. An atmospheric pressure ionization mass spectrometer according to claim 6, wherein said discharge electrode means comprises an assembly of a plurality of needle electrodes.

8. An atmospheric pressure ionization mass spectrometer according to claim 6, wherein said discharge electrode means is a circumferential surface of a fine conductive wire whose diameter is in the range of about 20 to 100 $\mu$m.

9. An atmospheric pressure ionization mass spectrometer according to claim 6, wherein said discharge electrode means comprises a plurality of whiskers formed on a periphery of a fine conductive wire.

10. An atmospheric pressure ionization mass spectrometer according to claim 6, wherein said discharge electrode means comprises a knife edge portion.

* * * * *